US007467593B2

(12) United States Patent
Jurnovoy

(10) Patent No.: US 7,467,593 B2
(45) Date of Patent: Dec. 23, 2008

(54) EMBROIDERED EMBLEM FOR SECURING TO A FIRST FABRIC

(75) Inventor: Carl Jurnovoy, Philadelphia, PA (US)

(73) Assignee: Penn Emblem Corporation, Philadelphia, PA (US)

( * ) Notice: Subject to any disclaimer, the term of this patent is extended or adjusted under 35 U.S.C. 154(b) by 100 days.

(21) Appl. No.: 11/625,103

(22) Filed: Jan. 19, 2007

(65) Prior Publication Data

US 2008/0173222 A1 Jul. 24, 2008

(51) Int. Cl.
*D05B 3/20* (2006.01)
*D05B 93/00* (2006.01)

(52) U.S. Cl. ..... 112/475.18; 112/439

(58) Field of Classification Search ..... 112/475.01, 112/475.08, 475.17, 475.18, 475.21, 475.22, 112/475.26, 440, 441, 439; 156/93
See application file for complete search history.

(56) References Cited

U.S. PATENT DOCUMENTS

| | | | | |
|---|---|---|---|---|
| 3,657,060 | A | 4/1972 | Haigh | |
| 3,816,211 | A | 6/1974 | Haigh | |
| 3,974,010 | A * | 8/1976 | Cox, Jr. | 156/93 |
| 4,092,451 | A | 5/1978 | Sernaker | |
| 4,140,563 | A | 2/1979 | Sernaker | |
| 4,597,198 | A * | 7/1986 | Schweitzer | 36/100 |
| 4,981,742 | A | 1/1991 | Haigh | |
| 5,009,943 | A | 4/1991 | Stahl | |
| 5,241,919 | A * | 9/1993 | LaGreca | 112/410 |
| 5,635,001 | A * | 6/1997 | Mahn, Jr. | 156/93 |
| 5,817,393 | A | 10/1998 | Stahl | |
| 5,878,681 | A | 3/1999 | Asami | |
| 6,653,249 | B1 | 11/2003 | Blumenthal | |
| 6,994,044 | B2 * | 2/2006 | Kwon | 112/475.18 |
| 7,011,030 | B1 | 3/2006 | Jans | |

* cited by examiner

*Primary Examiner*—Ismael Izaguirre
(74) *Attorney, Agent, or Firm*—Panitch Schwarze Belisario & Nadel LLP

(57) ABSTRACT

An embroidered emblem for securing to a first fabric is comprised of a fabric base having a front surface and a rear surface. The fabric base is made of the same or substantially the same material as the first fabric and has the same or substantially the same weave pattern and color as the first fabric. A design is embroidered into the fabric base, the design including a stitched border extending around the outer periphery of the front surface of the fabric base. The border is made utilizing a relatively small sized needle and a relatively thin, dull yarn which is the same or substantially the same color as the color of fabric base. In this manner, when the embroidered emblem is secured to the first fabric the border as well as the fabric base fades into the first fabric so as to be nearly invisible.

6 Claims, 1 Drawing Sheet

EMBROIDERED EMBLEM FOR SECURING TO A FIRST FABRIC

BACKGROUND OF THE INVENTION

The present invention relates to an embroidered emblem and a method of making an embroidered emblem and, in particular, an embroidered emblem and a method of making an embroidered emblem having an appearance so that when the emblem is applied to a garment or other fabric, it appears as though the embroidery has been applied directly to the garment or other fabric.

In general, embroidered emblems and methods for making embroidered emblems are well known in the art. A particular embroidered emblem and method of making the embroidered emblem is disclosed in U.S. Pat. No. 3,657,060 entitled "Embroidered Emblem With Thermoplastic Adhesive" and U.S. Pat. No. 3,816,211 entitled "Method For Making Embroidered Emblem" both of which are owned by the assignee of the present application. These two related patents disclose an embroidered emblem 110 of the type shown in FIGS. 1 and 2 of the present application and which comprises a fabric base 112 with an embroidered design 114, including an embroidered border around the periphery of the base fabric 112, on at least a front or first principal surface 116 of the fabric base 112 and a thermoplastic adhesive material 118 laminated or bonded to the rear or second principal surface 120 of the fabric base 112. In this manner, the embroidered emblem 110 can be conveniently fastened to a garment or other fabric surface through the application of at least one of heat and pressure to melt the thermoplastic material 118 and thereby bond the fabric base 112 to the garment or other fabric surface. A similar emblem and method is disclosed in U.S. Pat. No. 4,981,742. The subject matter of each of the three above-mentioned patents is hereby incorporated by reference into the present application.

While the emblems disclosed in the three above-mentioned patents are quite acceptable and while the methods disclosed in the patents are quite useful in manufacturing such emblems, there is a need in the art for an emblem which provides an enhanced appearance when secured to a garment or other fabric. In particular, there is a need for an embroidered emblem which has a fabric base which is the same as or substantially the same as the fabric of the garment or other fabric surface to which the emblem will be secured so that when the embroidered emblem is secured to the garment or other fabric surface the fabric base blends in with the garment or other fabric surface so that it appears as though the embroidered design of the emblem was embroidered directly onto the garment or other fabric surface. For example, in some industries in which employees wear uniforms, the uniforms may have one or more embroidered emblems such as a company logo applied to the uniform shirt or jacket. Typically the names or other personalized information of the employees are embroidered directly onto the uniform shirt or jacket to provide a cleaner, neater appearance. Direct embroidery of an employee name in this manner adds substantial expense to the cost of the garment and, because removal of such direct embroidery is not feasible, precludes the garment from being re-used by another employee when the named employee leaves the company. The present invention provides an embroidered emblem which has the appearance of direct embroidery when applied to a garment but which is much less expensive to produce and apply to the garment and which can be conveniently and completely removed from the garment to permit re-use of the garment.

BRIEF SUMMARY OF THE INVENTION

Briefly stated, the present invention, in one embodiment, comprises an embroidered emblem for securing to a first fabric by the application of at least one of heat and pressure. The first fabric is made of a material having a predetermined weave pattern and a predetermined color. The embroidered emblem comprises a fabric base having a front surface and a rear surface, the fabric base being made of the same or substantially the same material as the first fabric and having the same or substantially the same weave pattern and color as the first fabric. A design is embroidered into the base fabric, the design including a stitched border extending around the periphery of the front surface of the fabric base. The border is made using a relatively small sized needle and a relatively thin, dull yarn which is the same or substantially the same color as the color of the fabric base so that the border is relatively small and fades into the fabric base so as to be nearly invisible. A layer of thermoplastic adhesive material is bonded to the rear surface of the fabric base for securing the emblem to the first fabric.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 3:
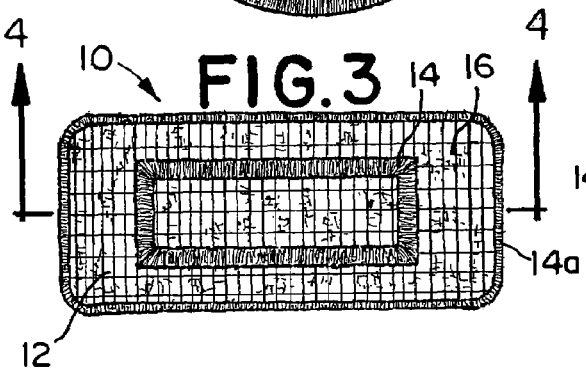
PRIOR ART FIG. 3
FIG. 3 is a top plan view of an embroidered emblem in accordance with a preferred embodiment of the present invention.
Figure 4:
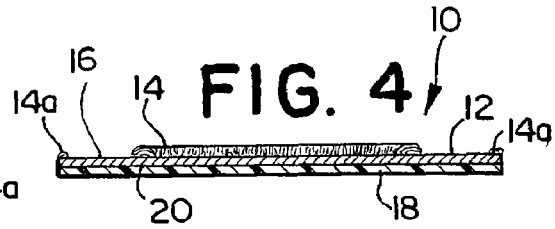
FIG. 4 is a sectional view of the emblem shown in FIG. 3 taken along line 4-4 of FIG. 3.
Figure 5:
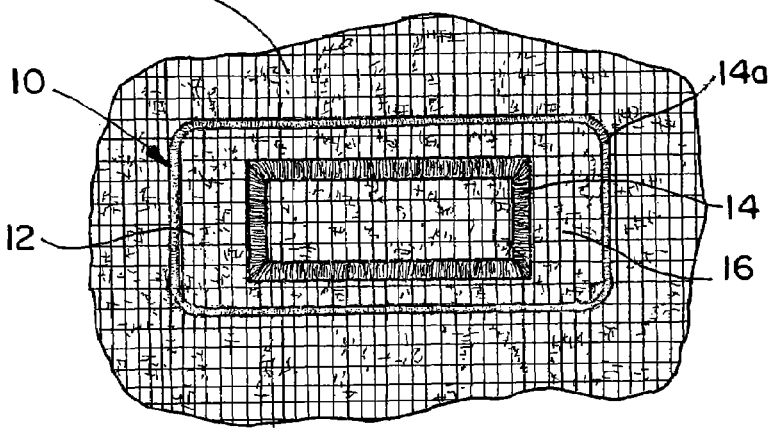
FIG. 5 is a top plan view of the emblem shown in FIG. 3 after the emblem has been secured to the fabric of a garment.

Referring now to the drawings, there is shown in FIGS. 3-5, a preferred embodiment of an embroidered emblem, generally 10, for securing to a first fabric 30 by the application of at least one of heat and pressure in a manner as described in detail in the above-identified U.S. patents. The fabric 30 may be a portion of a garment, such as a shirt, smock, apron, hat or any other article of clothing. Alternatively, the fabric 30 may be some other article such as a banner, flag or any other article formed of the first fabric 30. Further, while it is preferred that the first fabric 30 be comprised of a woven textile fabric such as 100% polyester, 100% cotton or a polyester/cotton blend of about 65% polyester and about 35% cotton, it should be clearly understood that the first fabric 30 may be made of any type of natural or synthetic textile material using techniques which are known to those of ordinary skill in the art. In short, the first fabric 30 may comprise virtually any suitable woven fabric which may or may not be coated or impregnated with one or more soil resisting or stain repellent treatments and may be colored utilizing standard textile dyes of a type well known to those of ordinary skill in the art. The first fabric 30 as show in FIG. 5 is comprised of a textile material having a predetermined weave pattern and a predetermined color. The particular weave pattern utilized in forming the first fabric 30 should not be considered to be a limitation on the present invention nor should the particular color of the first fabric 30. Accordingly, it should be clearly understood that the embroidered emblem 10 in accordance with the present invention may be secured to a first fabric 30 having any type of weave pattern and any desired color without departing from the scope and spirit of the present invention.

As shown in FIGS. 3-5, the embroidered emblem 10 is comprised of a fabric base 12 having a first principal or front surface 16 and a second principal or rear surface 20. In the present embodiment the fabric base 12 is generally rectangularly shaped in plan view. It will be appreciated by those of ordinary skill in the art that the shape of the fabric base 12 as well as the size of the fabric base 12 may vary in particular applications. More specifically, the fabric base 12 may be circular, square, triangular or any other desired shape. As can be seen when viewing FIGS. 3 and 5, the fabric base 12 is made of the same or substantially the same material as the first fabric 30. The fabric base 12 has the same or substantially the same weave pattern as that of the first fabric 30 and is of the same or substantially the same color as the color of the first fabric 30. Most preferably, the fabric base 12 is of the exact same material as the first fabric 30. This feature of the present invention is particularly important because when an embroidered emblem 10 in accordance with the present invention is secured to the first fabric 30 the fabric base 12 should precisely match the first fabric 30 so that the fabric base 12 blends in with and substantially disappears into the first fabric 30.

The emblem 10 further includes an embroidered design 14 which is embroidered into the fabric base 12 in the manner well known in the art and described in detail in the above-identified U.S. patents. As shown in FIGS. 3 and 5, the embroidered design includes a principal design 14 in the form of a generally rectangular pattern. It will be appreciated by those of ordinary skill in the art that the generally rectangular shaped embroidered design 14 is presented only for purposes of illustrating the present invention and should not be considered to be a limitation on the present invention. Virtually any other type of embroidered design including designs of different shapes and sizes as well as embroidered designs of different colors may alternatively be used.

Figure 1:
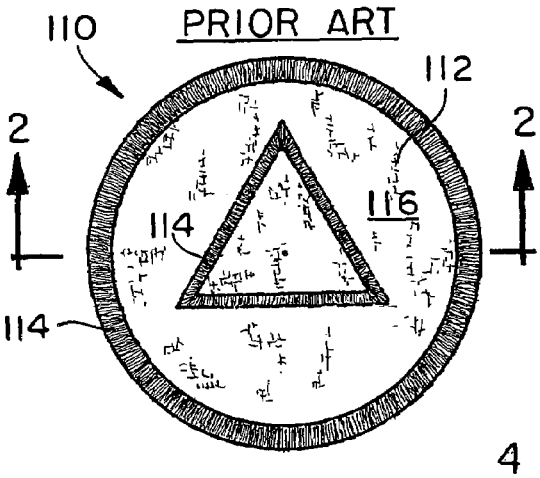
FIG. 1 PRIOR ART
FIG. 1 is a top plan view of an embroidered emblem in accordance with the prior art.
Figure 2:
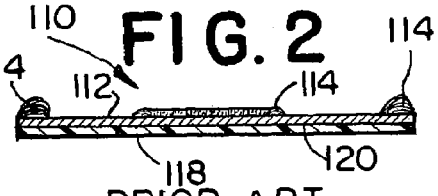
FIG. 2 is a sectional view of the prior art emblem taken along line 2-2 of FIG. 1.

The embroidered design 14 also includes a border 14*a* extending around the outer periphery of at least the front surface 16 of the fabric base 12. The border 14*a* is made utilizing a relatively small sized needle and a relatively thin yarn which is the same or substantially the same color as the color of fabric base 12 but which is duller. Typically, in a prior art emblem 110 the border 14*a* which is used is a Merrow border which is typically made using a continuous filament 100% polyester extremely bright yarn typically in size 300/4's—1200 Denier. Typically a large needle, such as a number 3DST needle is used to make such a Merrow border. The Merrow border is extremely bright and is very heavy and broad and quite visible as shown in FIGS. 1 and 2. The border 14*a* of the present emblem 10 is a stitched border which is made using a much smaller 100% spun polyester intentionally dull yarn in size Tex 27-60.5 Denier. The needle employed for forming the stitched border 14*a* of the present invention is preferably a number DBXK5 needle which is much smaller than the needle used for the Merrow border. By making a stitched border 14*a* utilizing a relatively small sized needle and by utilizing a relatively thin intentionally dull yarn which is the same or substantially the same color as that of the fabric base 12, the embroidered border 14*a* is relatively small and fades into the fabric base 12 and into the first fabric 30 to become practically invisible when the embroidered emblem 10 has been secured to the first fabric 30 so as to be nearly invisible as shown in FIG. 5.

The embroidered emblem 10 further includes a layer of thermoplastic adhesive material 18 which is laminated or bonded to the rear surface 20 of the fabric base 12. The thermoplastic adhesive material 18 is preferably a polyurethane which is the same as or substantially the same as the thermoplastic adhesive material described in detail in the above-identified patent applications and is bonded to the rear surface 20 of the fabric base 12 in the manner described in the above-identified U.S. patent applications. The layer of thermoplastic adhesive material 18 is used for securing the emblem 10 to the first fabric 30 by the application of at least one of heat and pressure in the manner described in detail in the above-identified U.S. patents. The emblem 10 may be made as a single emblem an entire sheet containing multiple emblems may be made at one time with each of the individual emblems being thereafter die cut or otherwise cut from the remainder of the emblem sheet. If desired, the individual emblems 10 may be finished by singeing the peripheral edge of the emblem 10 using a heat source of a type well known in the art to seal the fibers along the outer edge of the fabric base 12 and thereby prevent any threads from the emblem 10 from unraveling during laundering of the first fabric 30 to which the emblem 10 has been secured.

FIG. 5 shows the embroidered emblem 10 secured to the first fabric 30. As can be seen, because the fabric base 12 is formed of the same material as the first fabric 30 and has the same or substantially the same weave pattern and color as the first fabric 30 and because the stitched border 14*a* is relatively small and is of the same color as the fabric base 12 and the first fabric 30, the emblem 10 blends in with the first fabric 30 so as to be nearly invisible. In this manner, the embroidered design 14 of the emblem 10 appears as though it has been directly embroidered onto the first fabric 30. Of course, as is well known in the art and as described in detail in the above-identified U.S. patents, the emblem 10 may be conveniently and cleanly removed from the first fabric 30 through the application of at least one of heat and pressure thereby permitting reuse of the first fabric 30 with our without the application of another emblem.

It will be appreciated by those skilled in the art that changes could be made to the embodiment described above without departing from the broad inventive concepts thereof. It is understood, therefore, that this invention is not limited to the particular embodiment disclosed, but it is intended to cover all modifications within the spirit and scope of the present invention as defined by the appended claims.

I claim:

1. An embroidered emblem for securing to a first fabric by the application of at least one of heat and pressure, the first fabric being made of a material having a predetermined weave pattern and a predetermined color, the emblem comprising:

a fabric base having a front surface and a rear surface, the fabric base being of the same or substantially the same material as the first fabric and having the same or substantially the same weave pattern and color as the first fabric;

a design embroidered into the fabric base, the design including a stitched border extending around the periphery of the front surface of the fabric base, the border being made using a relatively small sized needle and a relatively thin, dull yarn which is the same or substantially the same color as the color of the fabric base so that the border is relatively small and fades into the fabric base so as to be nearly invisible; and a layer of thermoplastic adhesive material bonded to the rear surface of the fabric base for securing the emblem to the first fabric.

2. An embroidered emblem as recited in claim 1 wherein the needle employed for making the stitched border is a number DBXK5 needle.

3. The embroidered emblem as recited in claim 1 wherein the yarn used for making the stitched border is a 100% spun polyester yarn in size Tex 27—60.5 Denier.

4. The embroidered emblem as recited in claim 1 wherein the first fabric and the fabric base comprise a woven fabric selected from the group consisting of polyester, cotton and combinations thereof.

5. The embroidered emblem as recited in claim 1 wherein the thermoplastic adhesive material is polyurethane.

6. A method of making an embroidered emblem for securing to a first fabric by the application of at least one of heat and pressure, the first fabric being made of a material having a predetermined weave pattern and a predetermined color, the method comprising:

providing a fabric base having a front surface and a rear surface, the fabric base being of the same or substantially the same material as the first fabric and having the same or substantially the same weave pattern and color as the first fabric;

embroidering a design into the fabric base, the design including a stitched border extending around the periphery of the front surface of the fabric base, the border being made using a relatively small sized needle and a relatively thin, dull yarn which is the same or substantially the same color as the color of the fabric base so that the border is relatively small and fades into the fabric base so as to be nearly invisible; and bonding a layer of thermoplastic adhesive material bonded to the rear surface of the fabric base for securing the emblem to the first fabric.

* * * * *